US006298202B1

(12) United States Patent
Fushiya et al.

(10) Patent No.: US 6,298,202 B1
(45) Date of Patent: Oct. 2, 2001

(54) IMAGE FORMING APPARATUS HAVING A SENSOR FOR DETERMINING WHETHER A REPLACEMENT UNIT IS NEW/OLD AND MOUNTED/NON-MOUNTED

(76) Inventors: Noriyuki Fushiya, 742-743, Higashiokamoto, Kawauchi-machi, Kawauchi-gun, Tochigi 329-1103; Mitsuhiro Koumoto, 1-1198-1-501, Nishiki, Utsunomiya-shi, Tochigi 321-0967, both of (JP)

( * ) Notice: Subject to any disclaimer, the term of this patent is extended or adjusted under 35 U.S.C. 154(b) by 0 days.

(21) Appl. No.: 09/658,139

(22) Filed: Sep. 8, 2000

(30) Foreign Application Priority Data

Feb. 9, 2000 (JP) ..... 12-031351

(51) Int. Cl.[7] ..... G03G 15/00
(52) U.S. Cl. ..... 399/12; 399/13; 399/113
(58) Field of Search ..... 399/12, 13, 24, 399/25, 26, 27, 113

(56) References Cited

U.S. PATENT DOCUMENTS 5,038,173 * 8/1991 Kusumoto ..... 399/13
5,053,816 * 10/1991 Takahashi ..... 399/12
5,101,231 * 3/1992 Saitoh ..... 399/29
5,122,837 * 6/1992 Sonoda et al. ..... 399/12
6,104,888 * 8/2000 Kobayashi ..... 399/12

FOREIGN PATENT DOCUMENTS 06-059528 * 3/1994 (JP) .

* cited by examiner

*Primary Examiner*—Sophia S. Chen

(57) ABSTRACT

An image forming apparatus of the present invention is provided with elements for use in image formation as expendable supplies; with a detachable replacement unit 108 having a movement 205 which can move from a first position to a second position but which once it moves to the second position, is prohibited from returning to the first position, having a moving member that serves to move the movement 205 from the first position to the second position, and having a drive mechanism that causes the moving member to move the movement 205 in conjunction with the drive of the elements; with a sensor 703 which detects a position of the movement 205; and with a controller which judges whether the replacement unit 108 is a new one or not on the basis of the result of detection of the sensor 703 anterior and posterior to the drive of the drive mechanism.

15 Claims, 10 Drawing Sheets

| PRE – DRIVE OUTPUT | | POST – DRIVE OUTPUT | | CONTENTS |
|---|---|---|---|---|
| H | INTERCEPTED | H | INTERCEPTED | NOT NEW, BUT UNIT MOUNTED |
| H | INTERCEPTED | L | TRANSMITTED | *** |
| L | TRANSMITTED | H | INTERCEPTED | NEW UNIT MOUNTED, WITH DRUM COUNTER CLEARED |
| L | TRANSMITTED | L | TRANSMITTED | DRUM UNIT UNMOUNTED |

IMAGE FORMING APPARATUS HAVING A SENSOR FOR DETERMINING WHETHER A REPLACEMENT UNIT IS NEW/OLD AND MOUNTED/NON-MOUNTED

BACKGROUND OF THE INVENTION

1. Field of the Invention

The present invention relates to an image forming apparatus having a photoreceptor, etc., for use in image formation, provided as replacement units in a replaceable manner.

2. Description of the Related Art

Such an image forming apparatus has hitherto been used whose photoreceptor, etc., associated with image formation are provided in the form of a replaceable unit. In this type of image forming apparatus, a uniformly charged photoreceptor is subjected to a selective exposure to light, to form a toner image thereon, the resultant toner image being transferred onto a record medium, for image formation. For ease of toner replenishment works, this image forming apparatus enables a toner accommodation part, a development roller, the photoreceptor, etc., to be provided as an integral replacement unit in a replaceable fashion. When toner within the toner accommodation part of the replacement unit runs short, a fresh, toner-filled replacement unit is mounted thereon for execution of the image formation.

Such a conventional technique has however entailed some problems which follow.

Elements constituting the replacement unit have different service lives, and the life of the entire replacement unit conforms to that of the element having the shortest lift. For this reason, even though the replacement unit still includes any serviceable elements therein, the entire replacement unit must be replaced with a new one together with these serviceable elements. Providing that the development roller comes to an end of the life with recording operations of 5,000 record sheets and that the photoreceptor comes to an end of the life with recording operations of 30,000 record sheets, the life of the entire replacement unit is set to be equal to that of the development roller. Thus, even though the photoreceptor could still be used, it must be discarded due to the expiration of life of the replacement unit. In this manner, replacement of still serviceable elements of the conventional replacement unit will lead to wasteful consumption of resources and meaningless increase in economic burdens on users more than needed.

Such a drawback can be solved by separating the replacement unit into a plurality of units. This enables only the units including elements whose lives have expired to be replaced separately with new ones, with serviceable units being continuously used.

In this case, a supply of toner to the development roller is performed through the toner accommodation part, and hence the amount of toner within the toner accommodation part is set to conform to the life of the development roller so that the expiration of the life of the development roller can be judged by detection of the absence of toner. However, once the amount of toner within the toner accommodation part is set to conform to the life of the development roller, it will become possible no longer to cause the amount of toner to conform to the life of the photosensitive roller. For this reason, the expiration of life of the photosensitive roller could not be judged by a manner of detecting the absence of toner.

Thus, to judge the life of the photoreceptor, the maximum number of record sheets recordable by the photoreceptor is preset and the number of record sheets is counted each time the photoreceptor makes its recording operation. Comparison is then made between the counted number of record sheets and the maximum number of record sheets recordable to thereby judge the expiration of life of the photoreceptor.

However, for judgement of whether the life of the photoreceptor has comes to an end, it is necessary to accurately count the number of record sheets recorded by the photoreceptor initially in fresh state. This necessitates a secure judgment of whether the replacement unit including the photoreceptor is a new one or not. A detection mechanism therefore needs to separately be provided for detecting whether the photoreceptor is a new one or not, resulting in an increased number of elements, posing a new problem of incurrence of raised costs.

The replacement unit including the photoreceptor is mounted with an electrostatic charger for electrostatically charging the photoreceptor in a uniform fashion. Then, the electrostatic charger is supplied with a high-voltage constant current so as to ensure that electric charges accumulated on the photoreceptor do not vary depending on the peripheral environment around the electrostatic charger. As a result, application of a high-voltage power with the replacement unit unmounted will allow a higher voltage than needed to be applied to the terminal provided on the apparatus body side for flowing the high-voltage current into the replacement unit. This may result in an occurrence of abnormality around the terminal, impairing the apparatus reliability.

Furthermore, in case of the separated replacement unit arrangement allowing only the replacement unit required depending on the life of each element to be replaced with a new one, detection must be made of whether each replacement unit has been mounted or not, on a replacement unit basis. This means that there must be additionally disposed a corresponding number of detection sensors to the number of the replacement units separated. This may bring about a further increase in the number of components of the image forming apparatus and a further rise of costs.

SUMMARY OF THE INVENTION

It is therefore an object of the present invention to provide an image forming apparatus having a replacement unit consisting of a plurality of elements which are provided separately on a life basis so that only requisite elements can be replaced with new ones, to thereby achieve an effective utilization of resources and a reduction in economic burdens on users. It is another object of the present invention to provide an image forming apparatus ensuring an accurate judgement of the life for each of separated unit elements and capable of minimizing the increase in the number of elements, even in case of such a life-based separation of the replacement unit into the plurality of elements.

According to an aspect of the present invention there is provided an image forming apparatus comprising a replacement unit having a projection which moves from a first position to a second position, and once moves to said second position being prohibited from returning to the first position, a moving member which moves the projection from the first position to the second position, and a drive mechanism which moves the moving member to move the projection in conjunction with drive of elements for use in image formation; a sensor which detects a position of the projection; and a controller which judges whether the replacement unit is a new one or not on the basis of respective positions of the projection that the sensor detects before and after the drive mechanism is driven.

Such an arrangement does not allow the projection of the replacement unit to move from the first position to the second position until the drive unit comes into operation. Due to such an arrangement as to restrain the projection from returning to the first position once it arrives at the second position, it is possible to securely judge whether the replacement unit is a new one or not by detecting positions of the projection that the sensor detects before and after the drive mechanism is driven. Thus, if the replacement unit is a new one, then life counters for elements associated with image formation are reset to initiate counting of record sheets, thereby enabling the lives of the elements for use in the image formation to be recognized in an accurate manner.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

An image forming apparatus in accordance with an embodiment of the present invention will now be described with reference to the accompanying drawings.

Figure 1:
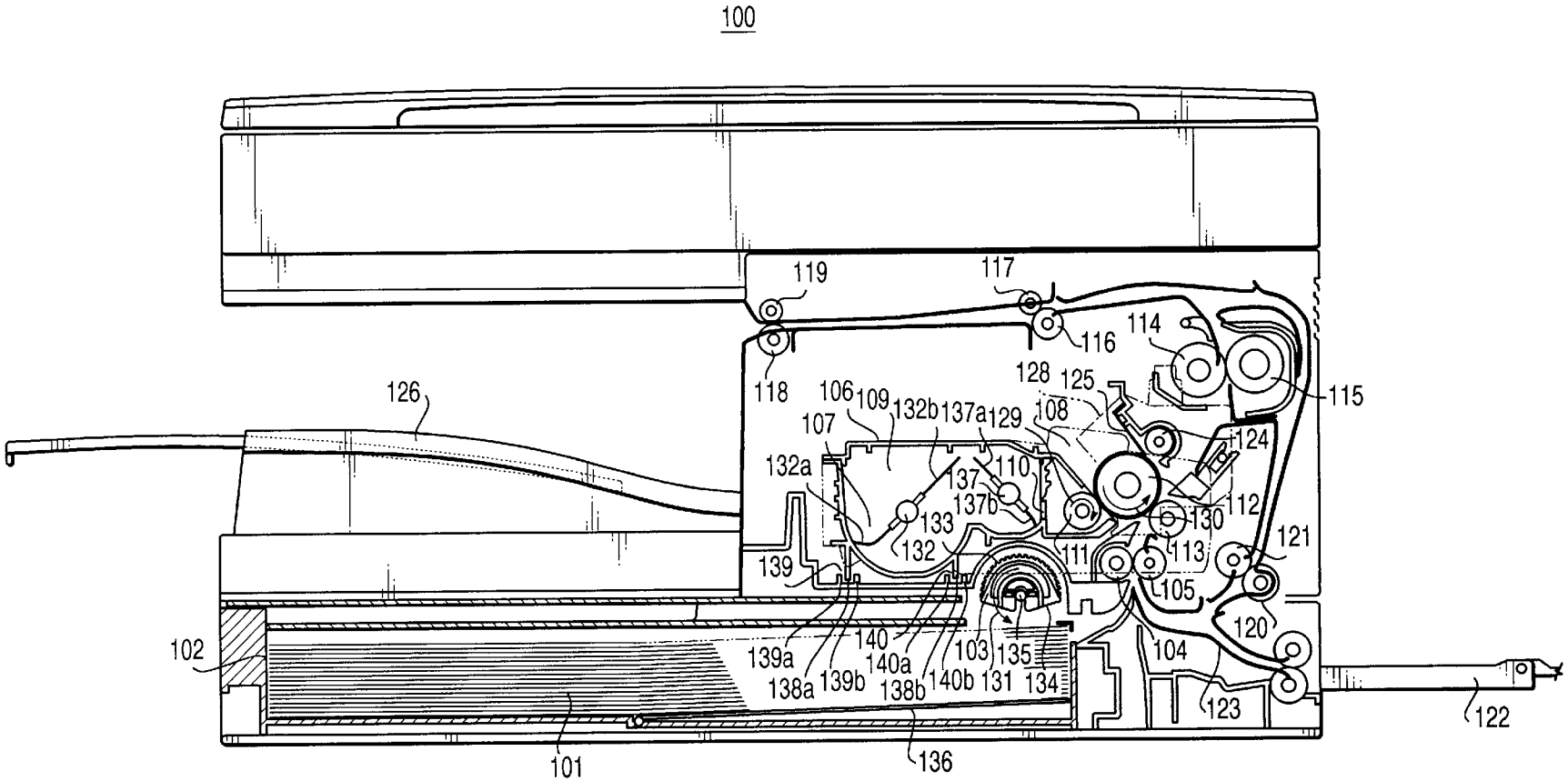
FIG. 1 is a sectional view of an image forming apparatus constructed in accordance with an embodiment of the present invention.

Referring first to FIG. 1, description will be made of a configuration of the image forming apparatus according to the embodiment. FIG. 1 is a sectional view showing the configuration of the image forming apparatus of this embodiment.

An apparatus denoted as 100 in FIG. 1 is the image forming apparatus according to the embodiment. A paper feed cassette 102 for storing a plurality of record sheets 101 is detachably mounted in the vicinity of the bottom of the image forming apparatus 100. A push-up plate 136 for pushing the stored record sheets 101 upward is provided on the bottom of the paper feed cassette 102.

The bottom of the image forming apparatus 100 is provided with no bottom plate. In other words, the paper feed cassette 102 is detached from the image forming apparatus 100, so that the bottom face of the image forming apparatus 100 is opened. Thus, the paper feed cassette 102 is detached from the image forming apparatus 100, and the image forming apparatus 100 is overturned, thereby facilitating the maintenance of components or elements provided in the vicinity of the bottom of the interior of the image forming apparatus 100.

A paper feeder is provided in the vicinity of the upper portion of the paper feed cassette 102 and in the vicinity of the terminal end in the direction where the paper feed cassette 102 is inserted. More specifically, the paper feeder comprises a paper feed roller 103 having a circular section whose part is interrupted and a shaft 135 acting as a rotational shaft of the paper feed roller 103 and fitted with the paper feed roller 103. On both sides of the shaft 135 acting as the rotational shaft, the paper feed roller 103 is provided with an arc part 133 that is arcuate in section about the shaft 135; and a non-arc part 134 that is non-circular in section with its shorter distance to the shaft 135 than the arc part 133. The arc part 133 is formed such that the distance between the arc part 133 and the shaft 135 is greater than that between the record sheet 101 pushed up by the push-up plate and the shaft 135. Furthermore, the non-arc part 134 is formed so as not to come into contact with the record sheet 101.

The paper feed roller 103 is rotated in a counterclockwise direction (in a direction of arrow indicated by 131 in FIG. 1). With rotations of the paper feed roller 103, the arc part 133 feeds the record sheets 101 to resist rollers 104, 105 which follow. The length of the arc of the arc part 133 is slightly longer than the distance between the paper feed roller 103 and the resist rollers 104, 105.

Further rotations of the paper feed roller 103 allow the non-arc part 134 instead of the arc part 133 to confront the record sheet 101. Thus, the paper feed roller 103 comes apart from the record sheets 101. This prevents the paper feed roller 103 from feeding the subsequent record sheet 101 in a successive manner.

The resist rollers 104, 105 are rotationally driven in response to image forming operations and feed the record sheets 101 to a nip defined between a transfer roller 113 located downstream in a conveyance direction from the resist rollers 104, 105 and a photosensitive roller 112 provided in a toner cartridge 106. Furthermore, the resist rollers 104, 105 register the photosensitive roller 112 at a record start position and the record sheet 101 at a record start position.

The photosensitive roller 112 is exposed by an optical unit not shown to form a latent image thereon. A toner image is then formed on the surface in conformity with the latent image. Incidentally, this embodiment employs the photosensitive roller 112 as a photoreceptor, but any photoreceptor which does not adopt a form of the roller may be used.

A voltage of opposite polarity to the toner image formed on the photosensitive roller 112 is applied to the transfer roller 113. The transfer roller 113 presses the record sheet 101 against the photosensitive roller 112, whereby the toner image of the photosensitive roller 112 is transferred onto the record sheet 101.

The toner image on the surface of the photosensitive roller 112 is transferred by the transfer roller 113 onto the record sheet 101 fed to the nip between the transfer roller 113 and the photosensitive roller 112. The record sheet 101 is then fed to a nip between a pressurizing roller 115 and a fixing roller 114 located downstream in the conveyance direction from the transfer roller 113.

A heater is disposed in the interior of the fixing roller 114. When the record sheet 101 is passed through between the pressurizing roller 115 and the fixing roller 114, it is pressed by the pressurizing roller 115 and fixing roller 114, while being heated by the fixing roller 114. The toner on the record sheets 101 is thus fixed onto the record sheet 101.

The toner-fixed record sheet 101 is then fed to a nip defined between intermediate discharge rollers 116 and 117 located downstream in the conveyance direction from the fixing roller 114. After the feed to the nip between the intermediate discharge rollers 116 and 117, the record sheet 101 is further fed to a nip defined between discharge rollers 118 and 119 located downstream in the conveyance direction and is discharged into a discharge paper reception part 126 outside the image forming device 100.

The image forming apparatus 100 is capable of double-side printing. Specifically, the intermediate discharge rollers 116, 117 and the discharge rollers 118, 119 are rotated reversely to the normal operation so that the record sheet 101 fed to the nips between the intermediate discharge rollers 116, 117 and between the discharge rollers 118, 119 are conveyed in a reverse direction. The record sheet 101 conveyed in the reverse direction is fed to reverse rollers 120, 121 and is further fed to the nip between the resist rollers 104, 105. In this manner, front and back faces of the record sheet 101 are reversed by feeding the record sheet 101. Thus, the reverse side to the previously printed side of the record sheet 101 is brought into contact with the photosensitive roller 112 so as to record an image by the toner image formed on the photosensitive roller 112.

The image forming apparatus 100 is provided with a manual feed tray 122. The record sheet placed in the manual feed tray 122 is fed via a conveyance route 123 to the resist rollers 104, 105 and then is passed through the route, for image recording.

The toner cartridge 106 will then be described. Toner to be used for the toner image formed on the photosensitive roller 112 is accommodated in the toner accommodation part 109 provided in the toner cartridge 106. The toner accommodation part 109 accommodates toner charged with magnetic properties. The toner accommodation part 109 has at the side thereof an opening 110 for feeding the toner to the exterior. The toner accommodation part 109 is provided with a film not shown for preventing any leakage and wetness of the toner accommodated in the toner accommodation part 109, the film covering the opening 110.

The interior of the toner accommodation part 109 is provided with toner feed members 132, 137 that rotate about a substantially central portion of the toner accommodation part 109. As films 132*a*, 132*b*, 137*a*, 137*b* are attached to both ends of the toner feed members 132, 137, the toner feed member 132 can stir the entire toner within the toner accommodation part 109 and feed it to the opening 110.

A magnet roller 111 is disposed in the vicinity of the opening 110 of the toner cartridge 106 and at such a position as to cover the opening 110. The magnet roller 111 has a magnet therewithin. The magnet roller 111 is thereby charged with magnetic properties, so that a toner layer charged with magnetic properties can be formed on a vertically extending curved face of the magnet roller 111, by rotating the magnet roller 111 in a direction indicated by arrow 129 (clockwise).

The photosensitive roller 112 is disposed at a position in proximity to the magnet roller 111. The photosensitive roller 112 is rotated in a direction indicated by arrow 130 (counterclockwise) so that the surface is electrostatically charged by a charging roller not shown provided in contact with the photosensitive roller 112. The charging roller is rotated following the rotation of the photosensitive roller 112. The photosensitive roller 112 is then exposed to light from an optical unit not shown disposed at the left side of the toner cartridge 106, via an opening 128 disposed at the side toward the optical unit of the toner cartridge 106. A latent image is thus formed on the surface of the photosensitive roller 112. The photosensitive roller 112 forms a toner image in conformity with the latent image on the surface by toner supplied from the magnet roller 111.

At the anterior side in the rotational direction of the photosensitive roller 112 there is provided a cleaning blade 125 a part of which comes into contact with the photosensitive roller 112. The cleaning blade 125 scrapes away toner, which has not been transferred onto the record sheet 101, remaining on the surface of the photosensitive roller 112. The remaining toner on the surface of the photosensitive roller 112 is thus removed so that the photosensitive roller 112 can subsequently securely form a desirable latent image thereon, thereby achieving a secure formation of a desirable toner image.

A discharge toner conveyance screw 124 is disposed in the vicinity of the cleaning blade 125. The discharge toner conveyance screw 124 is screw-shaped, and is rotated around its shaft so that discharge toner is discharged into a discharge toner collection box as described later. In this manner, the discharge toner is discharged to the exterior of the toner cartridge 106, for collection.

The toner cartridge 106 is constituted by a first replacement unit 107 comprising the toner accommodation part 109 and the magnet roller 111, and by a second replacement unit 108 comprising the photosensitive roller 112, the discharge toner conveyance screw 124, and the cleaning blade 125. It is thus possible to separate into two sections, i.e., one for accommodating elements or toner which are fast in consumption, i.e., which have relatively short lives and hence which need to frequently be replaced with new ones, and the other including the expensive photosensitive roller 112 which is relatively slow in consumption, i.e., which has a long life, and hence which does not need a frequent replacement. In this manner, the replacement unit is separated into the two sections on an element life basis, whereby only the requisite unit can be replaced with a new one depending on the lives of the elements. It is thus possible to eliminate such an inconvenience that when the life of a certain element comes to an end, the other elements having lives left must also be replaced with new ones, thereby achieving an effective utilization of resources and suppressing a greater economic burden on users than needed. It is thereby possible to replace only the elements needing frequent replacement and to continuously exploit the expensive elements. As a result, the running costs of the image forming apparatus 100 can be reduced.

The bottom of the first replacement unit 107 is provided with a pair of downwardly extending protuberances 138*a*,

138*b*. At positions confronting the pair of protuberances 138*a*, 138*b* of the first replacement unit 107 of the image forming apparatus 100, guide members 139, 140 are provided for guiding the first replacement unit 107 to the interior of the apparatus. The guide members 139, 140 are comprised of a pair of protuberances 139*a*, 139*b* and 140*a*, 140*b* extending substantially vertically relative to the first replacement unit 107.

With the protuberances 138*a*, 138*b* of the first replacement unit 107 being inserted into a space defined between the protuberances 139*a*, 139*b* and 140*a*, 140*b* of the guide members 139, 140, the first replacement unit 107 is slid into the interior of the image forming apparatus 100 from the side thereof so that the first replacement unit 107 is mounted on the image forming apparatus 100.

Furthermore, upon the separation of the toner cartridge 106, the magnet roller 111 serves also as a cover for preventing the toner discharged from the toner accommodation part 109 from being scattered outside.

Figure 2:
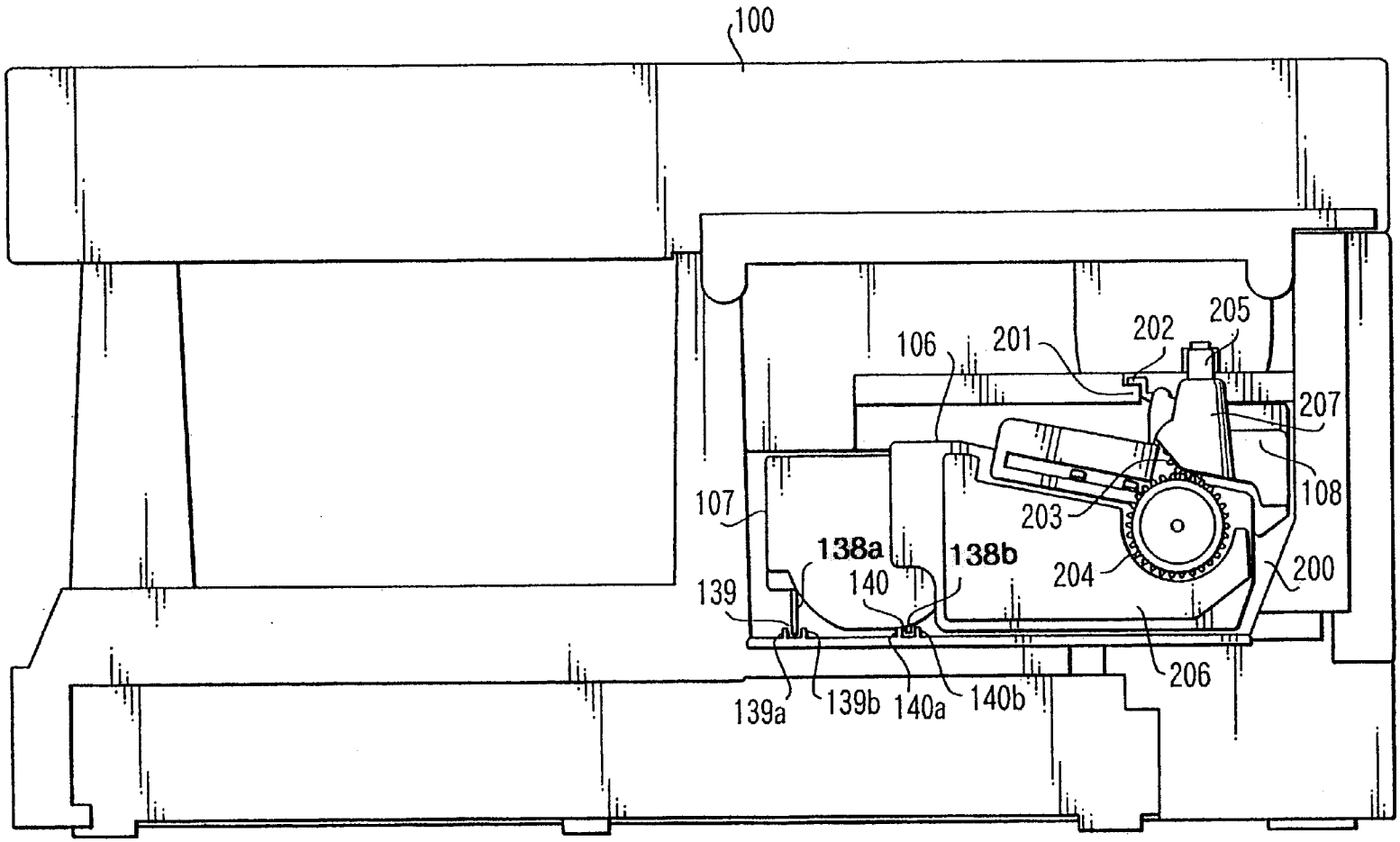
FIG. 2 is a side elevational view of the image forming apparatus according to the embodiment.

The configuration of the toner cartridge 106 will then be described. Referring first to FIG. 2, description will be made of mounting of the toner cartridge 106 onto the image forming apparatus 100. FIG. 2 is a side elevational view of the image forming apparatus according to the embodiment.

The toner cartridge 106 is stored in a toner cartridge accommodation part 200 disposed on the side face of the image forming apparatus 100. A grooved guide 201 is formed in the upper portion of the toner cartridge accommodation part 200. On the other hand, an engagement part 202 corresponding in shape to the guide 201 is provided on the upper side of the second replacement unit 108. The engagement part 202 of the second replacement unit 108 is engaged with the guide 201 of the image forming apparatus 100, and the second replacement unit 108 is slid into the interior of the image forming apparatus 100 from the side thereof, whereby the second replacement unit 108 is stored in the image forming apparatus 100.

As is apparent from FIG. 2, the protuberances 139*a*, 139*b*, 140*a*, 140*b* of the guide members 139, 140 project upward from the bottom of the toner cartridge accommodation part 200.

A discharge toner gear 203 coupled to the discharge toner conveyance screw 124 is provided at the side of the second replacement unit 108 and at the portion outside when the second replacement unit 108 is received in the toner cartridge accommodation part 200. The discharge toner gear 203 is coupled to a discharge toner conveyance gear 204 for driving a discharge toner conveyance member (not shown) that serves to further convey discharge toners accommodated in the discharge toner collection box 206 to the far side of the discharge toner collection box 206. In this manner, the discharge toner gear 203 and the discharge toner conveyance gear 204 are coupled together, so that the discharge toner conveyance member can operate in conjunction with rotations of the discharge toner conveyance screw 124. Thus, the discharge toner fed by the discharge toner conveyance screw 124 is securely conveyed to the interior without remaining at the inlet of the discharge toner collection box 206. Furthermore, rotational force of the discharge toner conveyance screw 124 works as a driving force for the discharge toner conveyance member, so that there is no need to additionally provide drive means for the discharge toner conveyance member. Thus, the number of elements of the image forming apparatus 100 is prevented from increasing.

The discharge toner gear 203 is provided with a drive member for driving a movement (projection) 205 for use in judging whether the second replacement unit 108 is a new one or not.

The image forming apparatus 100 has at the side thereof a retention part 207 for retaining the movement 205. The retention part 207 serves to regulate leftward and rightward motions of the movement 205. The retention part 207 is configured to cover most of the discharge toner gear 203, for providing a protection of the discharge toner gear 203.

Figure 3:
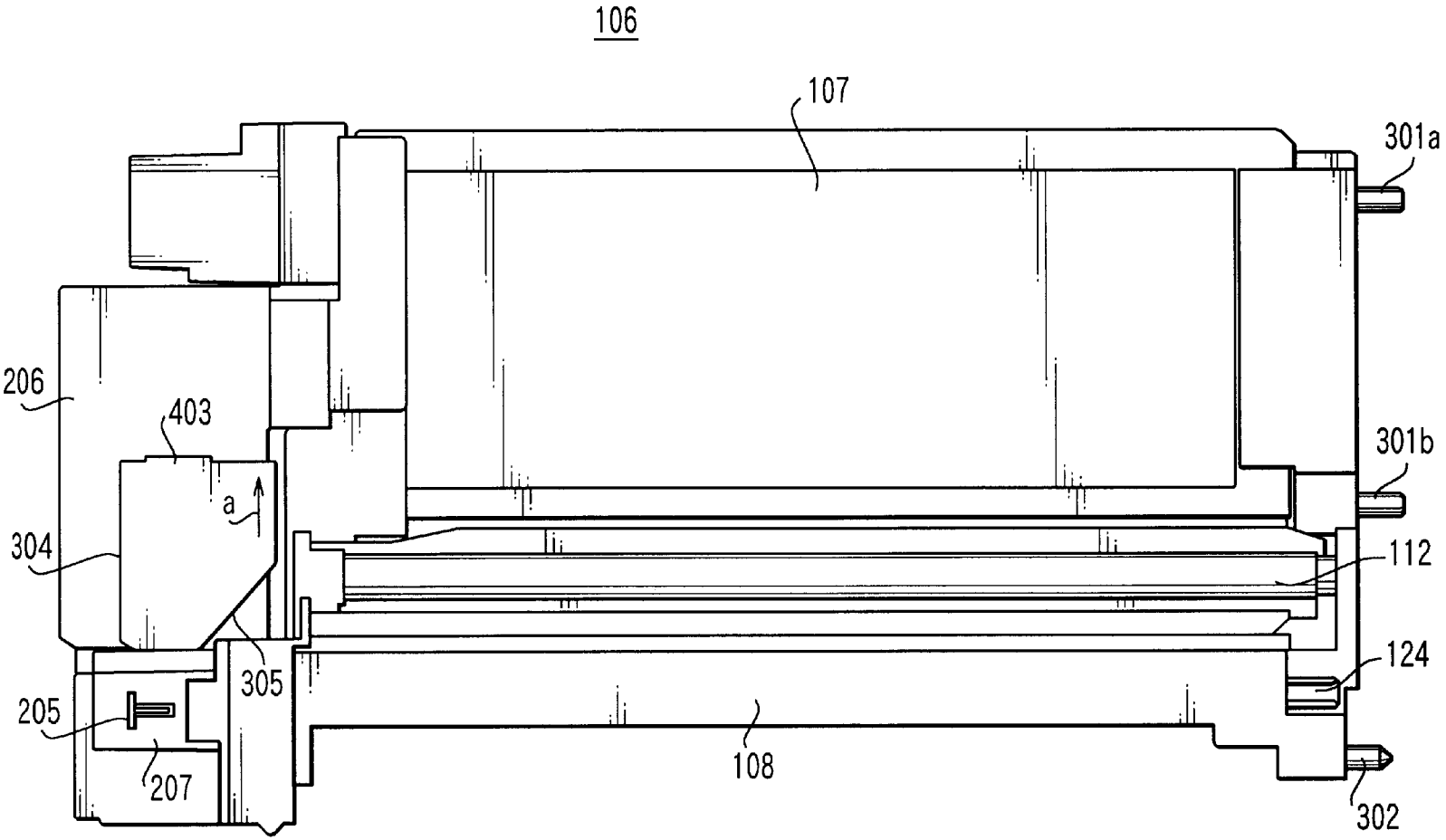
FIG. 3 is a top plan view of a toner cartridge according to the embodiment.
Figure 4:
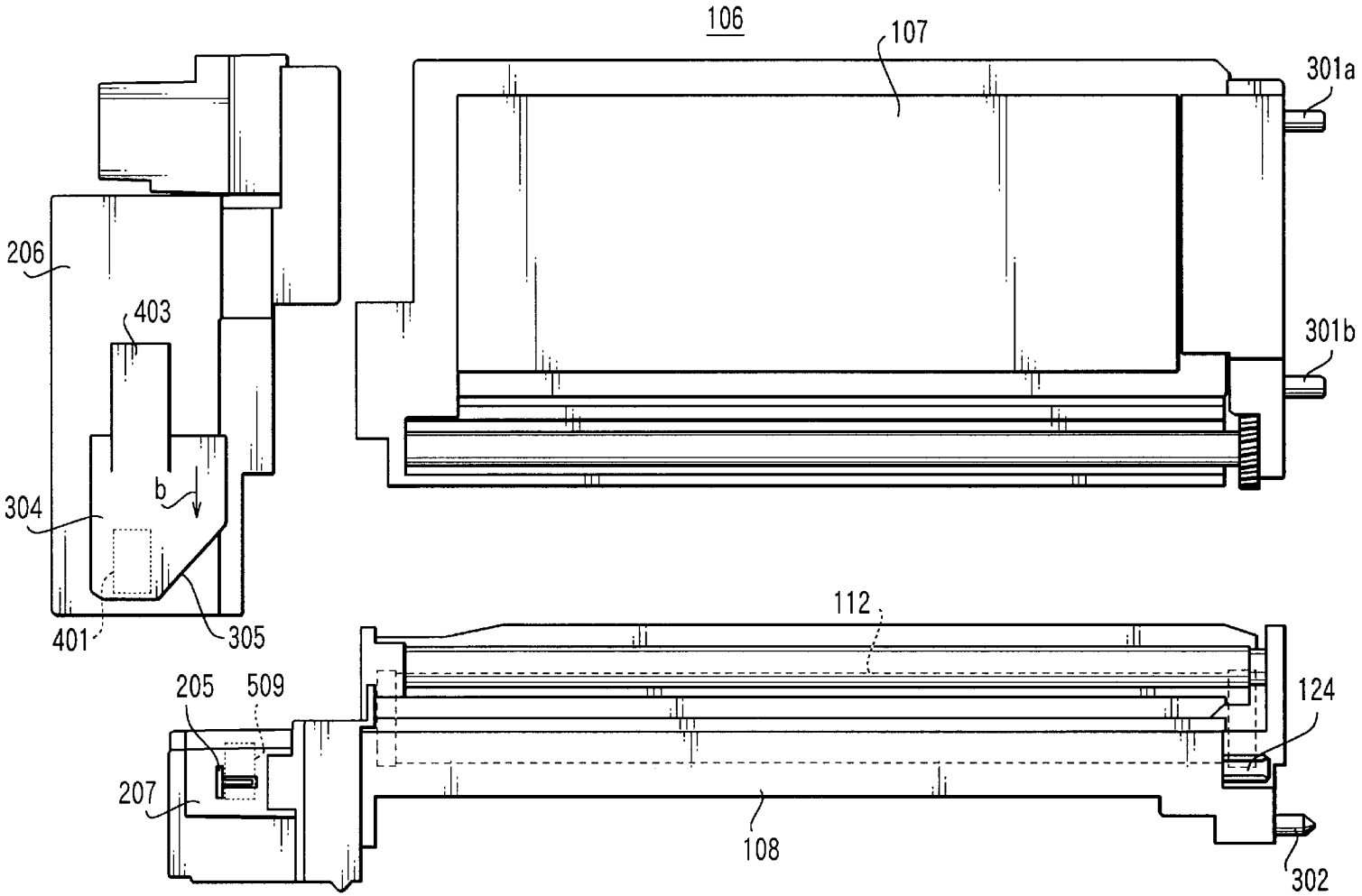
FIG. 4 is an exploded top plane view of the toner cartridge according to the embodiment.

Reference is then made to FIGS. 3 and 4 to describe the structure of the toner cartridge 106. FIG. 3 is a top plan view of the toner cartridge according to the embodiment, and FIG. 4 is an exploded top plan view of the toner cartridge according to the embodiment.

At the far side-portion when the first replacement unit 107 of the toner cartridge 106 is mounted on the image forming apparatus 100, the first replacement unit 107 is formed with a pair of protuberances 301*a*, 301*b*. The protuberances 301*a*, 301*b* project in a longitudinal direction of the first replacement unit 107. These protuberances 301*a*, 301*b* are fitted into a lock not shown provided in the image forming device 100, whereby the first replacement unit 107 is retained in position within the image forming apparatus 100.

At the far side-portion when the second replacement unit 108 of the toner cartridge 106 is mounted on the image formation apparatus 100, the second replacement unit 108 is formed with a protuberance 302 that protrudes in the longitudinal direction of the second replacement unit 108. The protuberance is fitted into a lock not shown provided in the image forming apparatus 100, whereby the second replacement unit 108 is retained in position within the image forming apparatus 100.

The discharge toner collection box 206 is releasably attached to the first replacement unit 107 at the near side-portion thereof when the first replacement unit 107 is mounted on the image forming apparatus 100. An opening 401 for collecting the discharge toner is formed in the top of the discharge toner collection box 206. A discharge toner cover 304 is also disposed in the top of the discharge toner collection box 206. The discharge toner cover 304 has at its bottom a guide 403 for retaining the discharge toner cover 304 in such a manner as to allow a move along a longitudinal direction of the discharge toner collection box 206. This allows the discharge toner cover 304 to vary from the opening 401 covering state to the opening exposure state.

Toward the first replacement unit 107 and at the side mounted with the second replacement unit 108, the discharge toner cover 304 is formed with a slant surface 305 that is tapered toward the second replacement unit 108. Upon the mounting of the first replacement unit 107, this enables a force applied by the second replacement unit 108 to the direction intersecting the direction where the discharge toner cover 304 is movable to act on a force in the direction where the discharge toner cover 304 moves in the movable direction. As a result, the discharge toner cover 304 securely moves toward the guide 403.

The diagram shown in FIG. 3 illustrates the state where the discharge toner cover 304 moves to the direction of arrow a, with the opening 401 being not covered with the discharge toner cover 304. The diagram shown in FIG. 4 illustrates the state where the discharge toner cover 304 moves to the direction of arrow b, with opening 401 being covered with the discharge toner cover 304.

Specifically, in a state that the first replacement unit 107 and second replacement unit 108 are combined with each other, the discharge toner cover 304 is pressed to a direction of arrow a by the second replacement unit 108 to expose the opening 401. Thus, the discharge toner conveyed by the discharge toner conveyance screw 124 (FIG. 5) can be accommodated in the discharge toner collection box 206. Furthermore, in a state that the first replacement unit 107 and second replacement unit 108 are disassembled from each other, the discharge toner cover 304 moves to a direction of arrow b by the second replacement unit 108 to cover the opening 401. Thus, the discharge toner accommodated in the discharge toner collection box 206 is prevented from spilling out.

Furthermore, at a position of the first replacement unit 107 confronting the second replacement unit 108, the magnet roller 111 is retained so as to expose the peripheral face. On the other hand, at a position of the second replacement unit 108 confronting the first replacement unit 107, the photosensitive roller 112 is retained so as to expose the peripheral face. Thus, when the first replacement unit 107 and second replacement unit 108 are combined with each other, the magnet roller 111 and photosensitive roller 112 are placed counter to each other on respective peripheral faces.

Furthermore, a magnet gear 402 for transmitting a rotational force to the magnet roller 111 is attached to a side of the magnet roller 111.

Furthermore, at the side at a side of the discharge toner collection box 206 of the second replacement unit 108, the movement 205 projecting upward is provided in a state that it is retained by the retention part 207.

Figure 5:
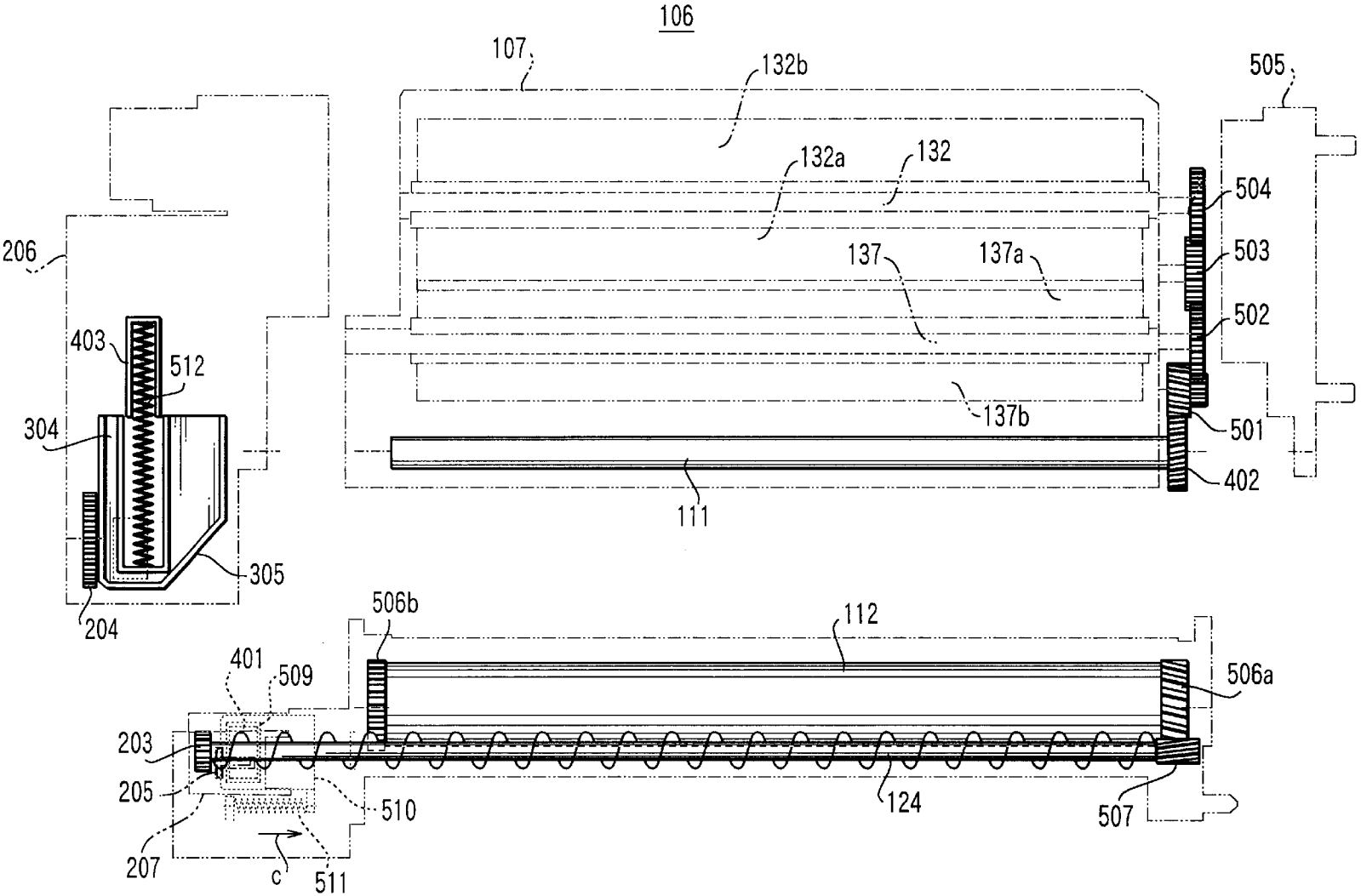
FIG. 5 is an exploded diagrammatic view of the toner cartridge according to the embodiment.

Then, a drive system provided in the first replacement unit 107 and second replacement unit 108 will be explained by use of FIG. 5. FIG. 5 is an exploded typical view of the toner cartridge according to the embodiment.

On a counter side of a side face of mounting the discharge toner collection box 206 of the first replacement unit 107, a gear 501 placed so as to couple with the magnet gear 402 of the magnet roller 111 is provided. Furthermore, the gear 501 is coupled to a toner feed gear 502 provided at a side end of the toner feed member 137. Furthermore, the toner feed gear 502 is coupled to a toner feed gear 504 provided at a side end of the toner feed member 132 via a gear 503. With this structure, the toner feed members 132, 137 are rotated by a driving force of rotating the magnet roller 111. Thereby, the driye means for rotating the toner feed members 132, 137 may not be separately provided. As a result, the number of elements of the image forming apparatus 100 is restricted to increase.

Furthermore, a detachable cover 505 is provided at a side end of the first replacement unit 107. Thus, the magnet gear 402, the gears 501, 503, and the toner feed gears 502, 504 are normally protected by the cover 505. Furthermore, the magnet gear 402, the gears 501, 503, and the toner feed gears 502, 504 can be subjected to maintenance by detaching the cover 505.

On the other hand, photoreceptor gears 506*a*, 506*b* are attached to both side ends of the photosensitive roller 112 of the second replacement unit 108, respectively. Furthermore, the discharge toner gears 203, 507 are also provided at both side ends of the discharge toner conveyance screw 124, respectively. The photoreceptor gear 506*a* is coupled to the discharge toner gear 507. Thereby, a driving force of rotating the photosensitive roller 112 is transmitted to the discharge toner conveyance screw 124. Thus, there is no need for providing the drive means for rotating the discharge toner conveyance screw 124. As a result, the number of elements of the image forming apparatus 100 is restricted to increase.

Furthermore, in a bottom in the vicinity of an end part where the movement 205 of the second replacement unit 108 is attached, a discharge port 509 for discharging the discharge toner conveyed by the discharge toner conveyance screw 124 is provided. An discharge toner cover 510 can be moved to a direction do arrow C, i.e. to a longitudinal direction of the discharge toner conveyance screw 124. Furthermore, a spring 511 in a state that is contracted is attached in the discharge toner cover 510 . Thereby, in a state that the second replacement unit 108 is separated, the discharge toner cover 510 is urged towards a direction of covering the discharge port 569 by the spring 511. As a result, in this state, the discharge port 509 is covered with the discharge toner cover 510. Thus, it is prevented to spill out the discharge toner from the discharge port 509.

Furthermore, a projection part (not shown) projecting downward of the second replacement unit 108 is formed in the discharge toner cover 510. It is possible to move the discharge toner cover 510 by applying a force on this projection part.

Furthermore, a spring 512 is accommodated inside the guide 403 of the discharge toner collection box 206 in a contracting state. Thereby, the spring 512 urges constantly so that the discharge toner cover 304 covers the opening 401. By so doing, in a state that the second replacement unit 108 is not attached to the discharge toner collection box 206, the discharge toner cover 304 is to cover the opening 401.

Figure 6:
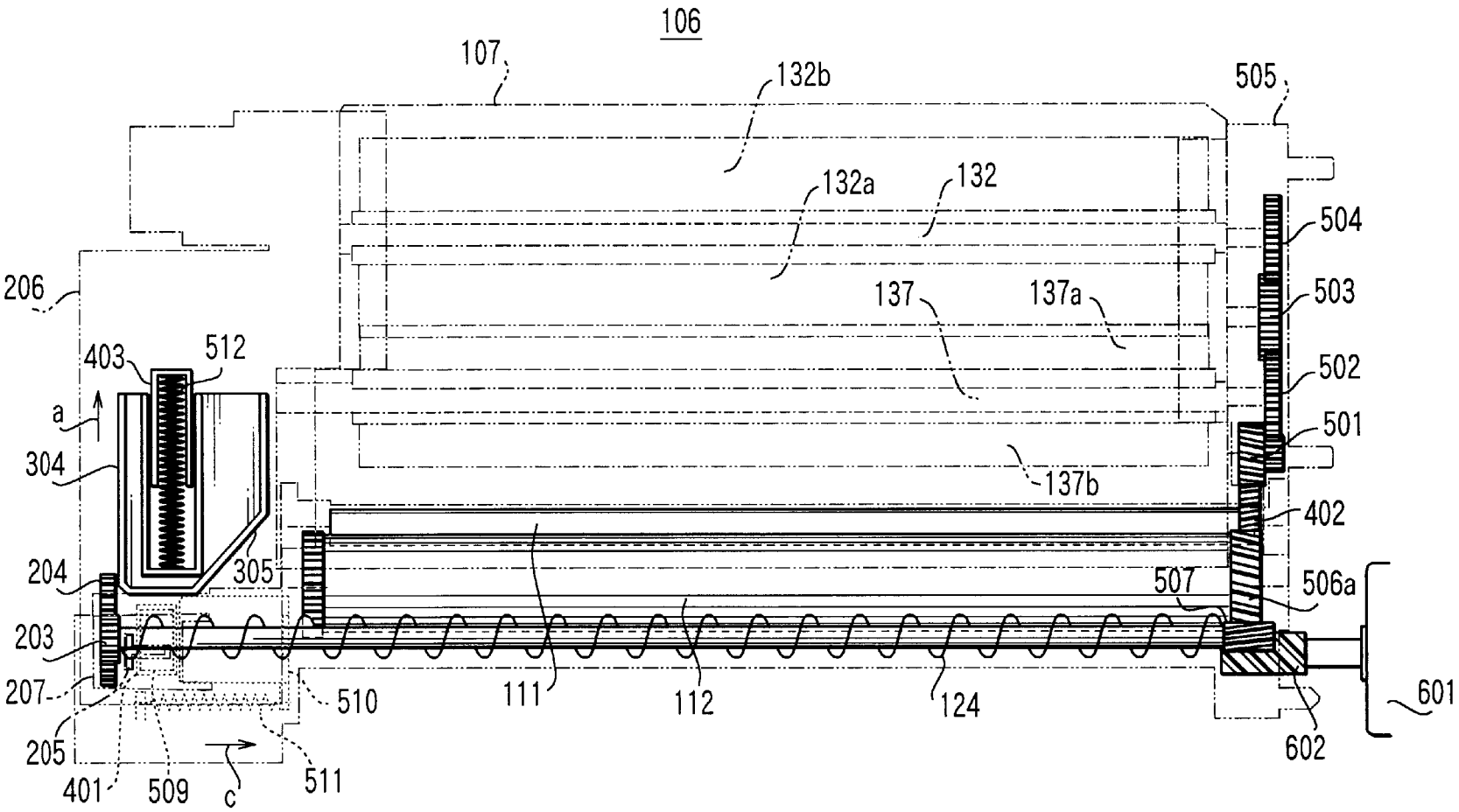
FIG. 6 is a diagrammatic view of the toner cartridge according of the embodiment.

Then, a transmission route of a driving force between the first replacement unit, second replacement unit, and discharge toner collection box 206 will be explained by use of FIG. 6. FIG. 6 is a typical view of the toner cartridge according to the embodiment.

A main motor 601 as drive means for transmitting a driving force to the toner cartridge 106 is provided in the image forming apparatus 100. A drive gear 602 is attached to the main motor 601. A rotational driving force of the main motor 601 is transmitted to the photoreceptor gear 506*a* of the photosensitive roller 112 via the drive gear 602. The photoreceptor gear 506*a* is coupled to the magnet gear 402 of the magnet roller 111 and the discharge toner gear 507 of the discharge toner conveyance screw. For this reason, a driving force transmitted to the photoreceptor gear 506*a* is transmitted to the magnet gear 402 and discharge toner gear 507.

The driving force transmitted to the magnet gear 402 is, as described above, transmitted to the gears 501, 503, and toner feed gears 502, 504. Furthermore, the driving force transmitted to the discharge toner gear 507 is transmitted to the discharge toner gear 203 via a main body of the discharge toner conveyance screw 124. The discharge toner gear 203 is coupled to the discharge toner conveyance gear 204. Thus, the driving force transmitted to the discharge toner gear 203 is transmitted to the discharge toner conveyance member via the discharge toner conveyance gear 204.

As described above, the magnet roller 111, photosensitive roller 112, discharge toner conveyance screw 124, toner feed members 132, 137, and discharge toner conveyance member are driven via the magnet gear 402, gears 501, 503, toner feed gears 502, 504, photoreceptor gear 506*a*, and discharge toner gears 203, 507 by the driving force of the one main motor 601. With this structure, the number of elements of the image forming apparatus 100 is restricted to increase.

Furthermore, when the first replacement unit 107 is fitted on the second replacement unit 108, a side face of the second replacement unit 108 is formed so as to press an inclined face of the discharge toner cover 304. Furthermore, substantially simultaneously therewith, a side face of the discharge toner collection box 206 is formed so as to press a projection part of the discharge toner cover 510 of the unillustrated second replacement unit 108. With this structure, the discharge toner cover 304 is moved, and simultaneously therewith, the discharge toner cover 510 is also moved to expose the opening 401 and discharge port 509. If the discharge toner collection box 206 is ended to couple with the second replacement unit 108, the opening 401 and discharge port 509 are confronting each other. With this structure, only by works of coupling the discharge toner collection box 206 with the second replacement unit 108, the opening 401 and discharge port 509 are disposed so as to confront each other. Thus, a user can readily couple the discharge toner collection box 206 with the second replacement unit 108.

Figure 7:
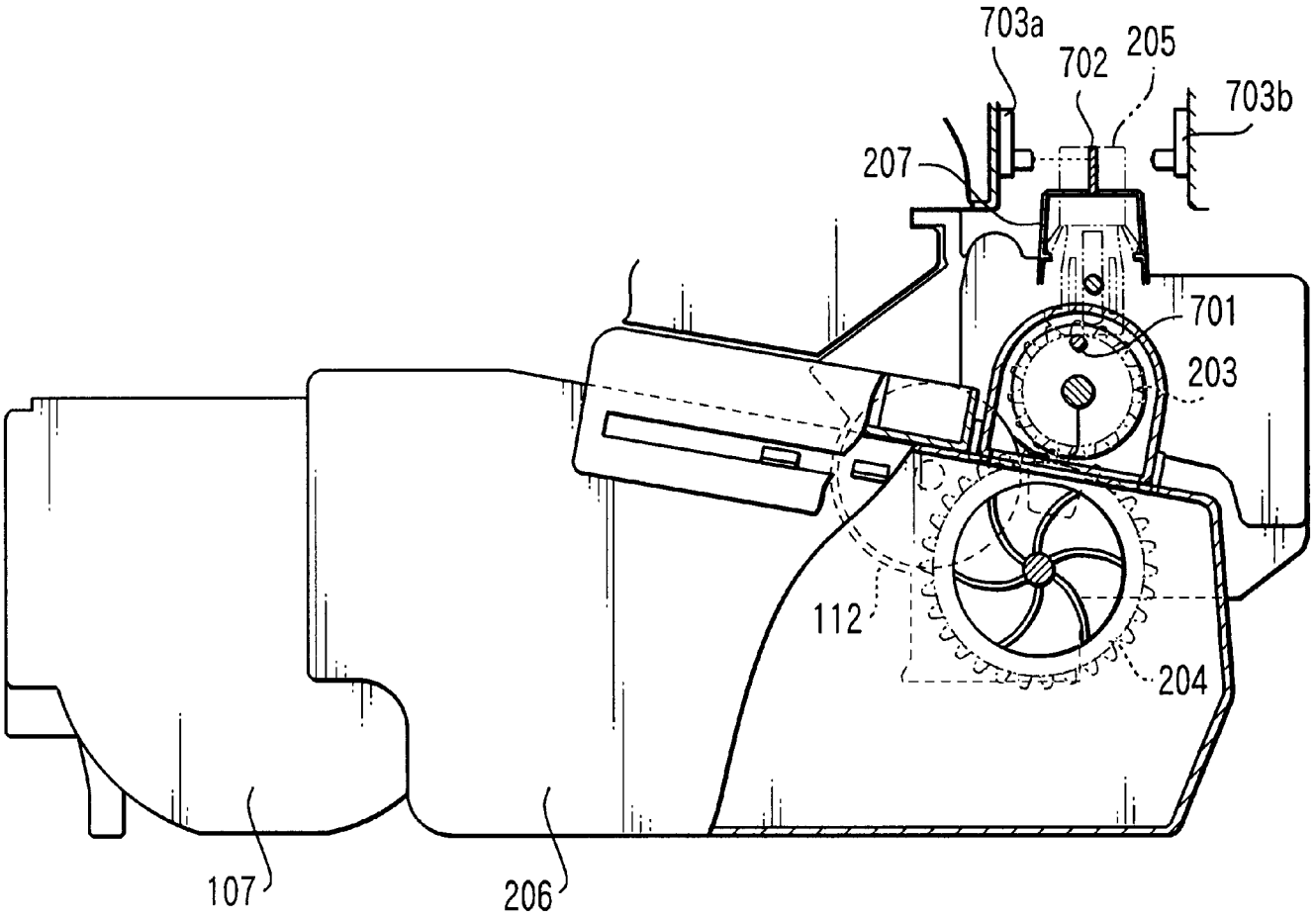
FIG. 7 is a sectional side elevation of the toner cartridge according to the embodiment.

Then, the drive means of the movement 205 will be explained by use of FIG. 7. FIG. 7 is a side sectional view of the toner cartridge according to the embodiment.

A projection part 701 is provided on the side face of the discharge toner gear 203 fitted on the discharge toner conveyance screw 124. The projection part 701 is provided in the vicinity to an outer peripheral face of the discharge toner gear 203. The projection part 701 is provided apart from a rotational shaft of the discharge toner gear 203 at a predetermined distance. Incidental to a rotation of the discharge toner gear 203, the projection part 701 comes into contact with the bottom of the movement 205 and pushes up the movement 205. A state shown in FIG. 7 is one that the movement 205 is pushed up by the discharge toner gear 203.

Furthermore, in an upper part of the movement 205, a plate part 702 is integrally formed along a longitudinal direction of the movement 205, i.e. along a vertical direction of FIG. 7. The plate part 702 projects to a substantially vertical direction to a longitudinal direction of the movement 205, i.e. in a depth direction of FIG. 7.

Detection sensors 703*a*, 703*b* are provided at a predetermined interval across the plate part 702, in the image forming apparatus 100. The detection sensor 703*a* irradiates beams to a direction of the plate part 702. The detection sensor 703*b* detects the beams irradiated from the detection sensor 703*a*. It is decided whether or not the beams are detected by the detection sensor 703*b*, so that it can be decided whether or not the movement 205 is in a state that it is pushed up.

Figures 8A, 8B, 8C, 8D:
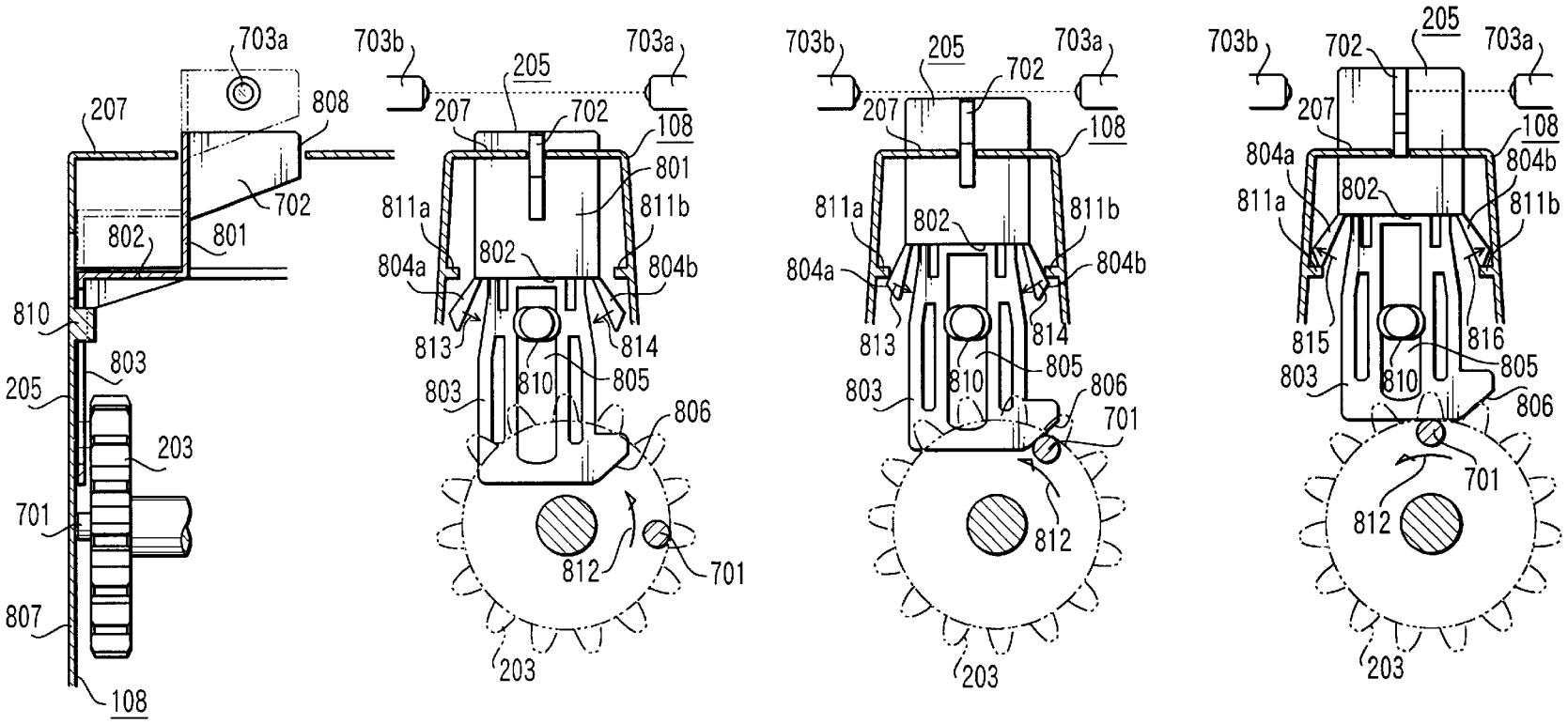
FIG. 8A is an enlarged sectional view of a movement according to the embodiment, as viewed from side.
FIG. 8B is an enlarged front elevational view of a first state of the movement according to the embodiment.
FIG. 8C is an enlarged front elevational view of a second state of the movement according to the embodiment.
FIG. 8D is an enlarged front elevational view of a third state of the movement according to the embodiment.

Then, the movement 205 will be explained. According to the present invention, there is provided the movement 205 having the structure that it is included inside the second replacement unit 108, and if it is once moved to an external direction, it is not returned inside. This move of the movement 205 is detected by the detection sensors 703*a*, 703*b*, and from the detection results of the detection sensors 703*a*, 703*b*, it is decided whether or not the second replacement unit 108 is a new one. Hereinafter, the movement 205 and moving means for moving the movement 205 will be explained by use of FIGS. 8A to 8D. FIG. 8A is an enlarged sectional view of the movement as viewed from sideward according to the embodiment, and FIGS. 8B to 8D are enlarged front views of a state of the movement according to the embodiment.

First of all, structures of the movement 205, the discharge toner gear 203 as moving means for moving the movement 205, and the projection part 701 formed in the discharge toner gear 203 as moving means for moving the movement 205 are described.

The movement 205 is disposed substantially vertically to a rotation shaft of the discharge toner gear 203. The movement 205 comprises a first horizontal face 803 of the lower part and a second horizontal face 801 of the upper part. The first horizontal face 803 is disposed substantially vertically to a rotation shaft of the discharge toner gear 203, and further a substantially rectangular opening 805 formed along a longitudinal direction is formed at a center part of the first horizontal face 803.

Furthermore, a lower end part in a longitudinal direction of the first horizontal face 803 is disposed so as to confront the discharge toner gear 203. In a part confronting the discharge toner gear 203 of the first horizontal face 803, there is formed an slant surface 806 having an inclined face coming into contact with the projection part 701 of the discharge toner gear 203 moved incidentally to a rotation of the discharge toner gear 203 from a normal line direction.

Furthermore, a vertical face 802 is provided in a coupling part of the first horizontal face 803 to the second horizontal face 801. This vertical face 802 is extended to a vertical direction of the first horizontal face 803, and also to a longitudinal direction of the discharge toner conveyance screw 124. In other words, the vertical face 802 is extended from sideward of the second replacement unit 108 to an inner direction thereof (FIG. 8A).

Furthermore, at both side ends at an end part coupled to the first horizontal face 803 on the vertical face 802, there are formed stoppers 804*a*, 804*b* as projection pieces extended to a direction of widening respective frontal ends to a longitudinal direction of the first horizontal face 803. The stoppers 804*a*, 804*b* are formed with an elastic member. For this reason, if a force is applied from a direction of intersecting the longitudinal direction, the stoppers 804*a*, 804*b* are shifted from a state of widening the respective frontal ends to the longitudinal direction of the first horizontal face 803 to a state of respectively pressing the frontal ends in directions of arrows 813, 814, by protuberances 811*a*, 811*b*.

Furthermore, at an end part on a counter side to the first horizontal face 803 of the vertical face 802, the second horizontal face 801 is formed as a face in parallel to the first horizontal face 803.

The plate part 702 is integrally formed with the second horizontal face 801 so as to extend in the same direction as the vertical face 802. The plate part 702 is provided along the longitudinal direction of the movement 205 at a substantially center of the second horizontal face 801. In other words, when the movement 205 is viewed from a direction of intersecting the longitudinal direction, a face of the plate part 702 can be viewed (FIG. 8A). Incidental to movements of the movement 205, the plate part 702 intercepts lights to be irradiated from the detection sensor 703*a* to the detection sensor 703*b*.

On the other hand, a stopper 810 is provided inside the accommodation part 207, entering an opening 805 of the movement 205. A diameter in a part towards the interior of the opening 805 of the stopper 810 is narrowed more than a width of the opening 805. Furthermore, a diameter in a part towards the exterior of the opening 805 of the stopper 810 is increased more than a width of the opening 805. The stopper 810 is inserted into the opening 805 from the fine elements that the movement 205 is retained so as to move vertically. Furthermore, as the stopper 810 is inserted into the interior of the opening 805, a range that the movement 205 moves to a vertical direction is regulated in the range that the stopper 810 can move in the interior of the opening 805. Furthermore, as a diameter of one end part of the stopper 810 is increased more than a width of the opening 805, the movement 205 is regulated in moving in an axial direction of the stopper 810.

Furthermore, at a position with which the stoppers 804*a*, 804*b* come into contact when the movement 205 at the side of the accommodation part 207 moves, there are formed the protuberances 811*a*, 811*b* so as to form a stepped portion with respect to the side face, respectively. The protuberances 811*a*, 811*b* are brought into contact with the stoppers 804*a*, 804*b* incidental to movements of the movement 205, thereby pressing the stoppers 804*a*, 804*b* to directions of arrows 813, 814 so as to approach a main body of the movement 205. Furthermore, after the motions of the movement 205 advance and the stoppers 804*a*, 804*b* pass the protuberances 811*a*, 811*b*, frontal ends of the stoppers 804*a*, 804*b* are restored in a direction of being made apart from the main body of the movement 205 by their own elastic forces, i.e. in an inverse direction to the arrows 813, 814. At this time, the protuberances 811*a*, 811*b* come into contact with the frontal ends of the stoppers 804*a*, 804*b*, and regulate that the movement 205 drops downward by its own weight.

As described above, setting the movement 205 to a condition that, if it mechanically, i.e. automatically once move to the exterior of the retention part 207, it does not move to the interior thereof, it becomes possible to detect a new one with high reliability instead of a simple structure.

In this connection, according to the embodiment, the stepped portion is formed on the side face of the retention part 207 by the protuberances 811*a*, 811*b*, but the stepped portion may be formed by recessing the side face of the retention part 207. Even in this case, the stoppers 804*a*, 804*b* are retained by the stepped portion of the retention part 207.

Furthermore, the retention part 207 is formed with a guide groove 808 through which the plate part 702 of the movement 205 passes. The plate part 702 is regulated in motions in a right and left direction by a side wall of the guide groove 808. Thus, when the movement 205 moves, it is prevented that it is inclined to a longitudinal direction.

Then, motions of the movement 205 will be explained by use of FIGS. 8B to 8D.

In the case where the second replacement unit 108 is mounted on the image forming apparatus 100, the movement 205 moves downmost by its own weight and is retained by the stopper 810. FIG. 8B is a view showing this state.

The image forming operations are started, and if the discharge toner gear 203 is rotated in a direction of arrow 812, i.e. counterclockwise, incidental to driving of the discharge toner conveyance screw 124, the projection part 701 of the discharge toner gear 203 comes into contact with the slant surface 806 of the movement 205. Furthermore, if a rotation of the discharge toner gear 203 advances, the projection part 701 pushes up the slant surface 806 to a rotational direction of the discharge toner gear 203. At this time, as a normal line direction of the slant surface 806 is approximately coincident with a moving direction of the projection part 701, the slant surface 806 can effectively receive a force from the projection part 701.

A force in which the projection part 701 pushes up the slant surface 806 to a normal line direction acts as a force of pushing up the movement 205 upward, thereby moving the movement 205 upward.

Furthermore, with the upward motions of the movement 205, the stoppers 804*a*, 804*b* of the movement 205 come into contact with the protuberances 811*a*, 811*b* of the second replacement unit 108. The stoppers 804*a*, 804*b* receive a force from the protuberances 811*a*, 811*b* and are bent to a direction of arrows 813, 814, respectively.

A view shown in FIG. 8C is one showing a state that the movement 205 is slightly pushed up by the projection part 701. Furthermore, in this state, lights irradiated from the detection sensor 703*a* to the detection sensor 703*b* are not intercepted by the plate part 702.

Furthermore, if a rotation of the discharge toner gear 203 advances, the projection part 701 comes into contact with the slant surface 806 and simultaneously moves. Thus, the movement 205 moves further upward. Furthermore, if the rotation of the discharge toner gear 203 advances, the projection part 701 is apart from the slant surface 806 and comes into contact with a lower end of the first horizontal part. The state at this time is one that the movement 205 is pushed up at a maximum by the projection part 701 (FIG. 8D).

At this time, the stoppers 804*a*, 804*b* of the movement 205 pass side portions of the protuberances 811*a*, 811*b* of the second replacement unit 108. The stoppers 804*a*, 804*b* do not receive a force from the protuberances 811*a*, 811*b*. Thus, the stoppers 804*a*, 804*b* return to directions of arrows 815, 816 with the elastic force, respectively.

The frontal ends of the stoppers 804*a*, 804*b* come into contact with upper face portions of the protuberances 811*a*, 811*b*, and the stoppers 804*a*, 804*b* do not move downward. Thus, the movement 205 is regulated in downward motions, too, and the movement 205 do not return downward, i.e. to an inner direction of the second replacement unit 108.

At the time of this state, lights irradiated from the detection sensor 703*a* to the detection sensor 703*b* are intercepted by the plate part 702.

Thus, operations of pushing up the movement 205 by the projection part 701 are ended.

As described above, with this structure, if the movement 205 is moved from the interior of the second replacement unit 108 to the exterior thereof by the discharge toner gear 203 and projection 701, as the moving means of the movement 205, it does not return. In other words, only in a state that the second replacement unit 108 is a new one, the movement 205 moves from the interior of the second replacement unit 108 to the exterior thereof. According to the present invention, aiming at this aspect, before driving of the discharge toner conveyance screw 124, in turn the main motor 601 and after the driving thereof, it is monitored whether or not the detection sensor 703*b* detects lights, thereby judging whether or not the second replacement unit 108 is a new one.

Furthermore, with such the simple structure, the movement 205 moves from the interior of the second replacement unit 108 to the exterior thereof, and if it has once moved to the exterior, it cannot move to the interior thereof. Furthermore, if the movement 205 has mechanically, i.e. automatically once moved to the exterior of the second replacement unit 108, it is not to move to the interior thereof. Therefore, with the simple structure, it becomes possible to detect a new one with high reliability.

Then, new one detection operations of the second replacement unit 108 by use of the movement 205 and detection sensors 703*a*, 703*b* as characteristics of the present invention will be described.

Figure 9:
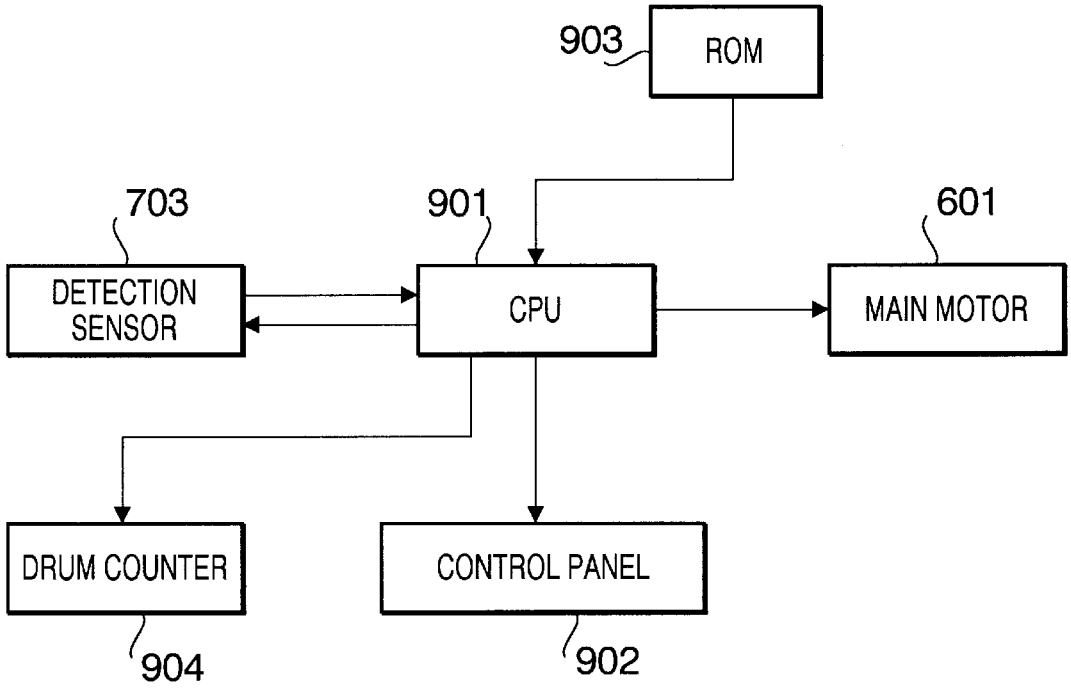
FIG. 9 is a hardware block diagram showing a configuration for detecting whether a second replacement unit according to the embodiment is a new one or not.

First of all, a hardware structure for detecting a new one of the second replacement unit according to the embodiment will be described by use of FIG. 9.

A CPU 901 controls various devices such as the detection sensor 703, the main motor 601, and the like with reference to programs stored in a ROM 903 according to a signal input from a control panel, etc.

A drum counter 904 is a counter that the second replacement unit 108 records the record operations and the number of record sheets. If the second replacement unit 108 is judged as a new one by detection results of the detection sensor 703, the CPU 901 resets a value of the drum counter 904. Thus, the CPU 901 can accurately judge whether or not the second replacement unit 108 comes to an end of lives by referring to the number of counter of the drum counter 904.

Figure 10:
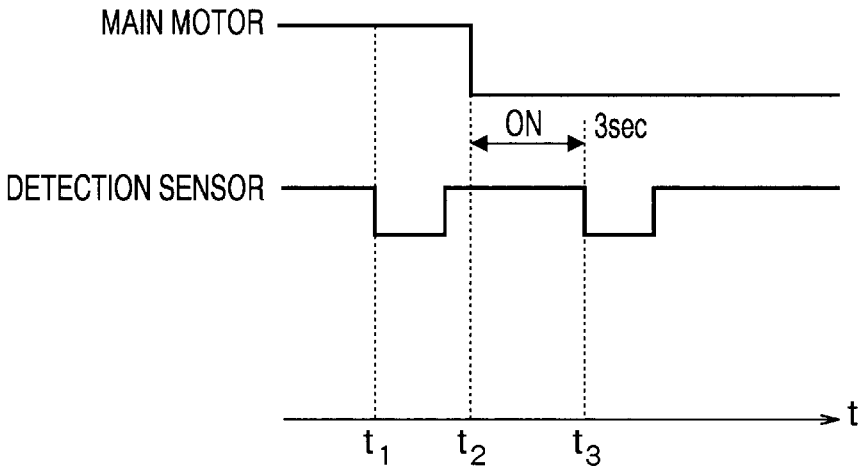
FIG. 10 is an operation timing chart of a main motor and a detection sensor according to the embodiment.

Furthermore, according to the present invention, it can also be judged whether or not the second replacement unit 108 is mounted on the image forming apparatus 100 by use of the movement 205 and detection sensors 703*a*, 703*b*. Specifically, the judgement is performed by respectively referring to the detection results of the detection sensor 703 at time t1 before driving of the main motor 601 and at time t3 after drive time t2 of the main motor 601 at a timing shown in FIG. 10.

Furthermore, the period of time between t2 and t3 is 3 sec. This period of time is one required after the discharge toner gear 203 is driven until the discharge toner gear 203 completes operations of pushing up the movement 205 by the projection part 701.

Hereinafter, the new one judgement and mounting judgement process of the second replacement unit 108 will in detail be described by use of an operating flow of FIG. 11.

If a main switch or door switch is turned ON (ST1001), the CPU 901 refers to the detection results of the detection sensor 703 prior to driving of the main motor 601 (ST1002). In order to detect whether or not the second replacement unit 108 is a new one, it is judged whether or not the detection sensor 703 detects lights, i.e. whether or not the movement 205 is in the interior of the second replacement unit 108 (ST1003).

At ST1003, in the case where the detection sensor 703 does not detect lights, it can be judged that the movement 205 moves in the exterior of the second replacement unit 108. This state denotes that the second replacement unit 108 is not a new one.

Then, operating the main motor 601 (ST1004), it is judged whether or not the detection sensor 703 again detects lights, i.e. whether or not the movement 205 is in the interior of the second replacement unit 108 (ST1005).

At ST1005, in the case where the detection sensor 703 detects lights, it can be judged that the movement 205 is in the interior of the second replacement unit 108. As the structure is made in which, if the movement 205 once comes out in the exterior of the second replacement unit 108, it doe not return to the interior, the above state cannot intrinsically be supposed. Thus, it is judged by the CPU 901 that this state is not supposed (ST1006). The CPU 901 displays this effect on a control panel 902. Thus, users can decide that there are any abnormalities in the apparatus.

On the other hand, at ST1005, in the case where the detection sensor 703 does not detect lights, it can be judged that, prior to driving of the main motor 601 and even after the driving thereof, the movement 205 moves in the exterior of the second replacement unit 108. Thereby, it is decided by the CPU 901 that the second replacement unit 108 is mounted on the image forming device 100 and also the second replacement unit 108 is not a new one (ST1007). The CPU 901 displays this effect on the control panel 902.

Furthermore, at ST1003, in the case where the detection sensor 703 does not detect lights, it can be judged that the movement 205 is in the interior of the second replacement unit 108. This state indicates that the second replacement unit 108 is a new one, or non-mounted. For this reason, it is necessary to clearly judge whether or not the second replacement unit 108 is a new one, or non-mounted.

For this reason, next, operating the main motor 601 (ST1008), it is judged whether or not the detection sensor 703 again detects lights, i.e. the movement 205 is in the interior of the second replacement unit 108 (ST1009).

At ST1005, in the case where the detection sensor 703 detects lights, it can be judged that, after the driving of the main motor 601, the movement 205 moved to the exterior of the second replacement unit 108. It can be judged that the second replacement unit 108 was a new one prior to ST1008, and was initially used at ST1008. Thereby, the CPU 901 judges that the second replacement unit of a new one is mounted on the image forming apparatus 100 and this effect is displayed on the control panel 902. The CPU 901 clears the number of counter of a drum counter 904 (ST1010). Thus, the CPU 901 can accurately judge lives of the second replacement unit 108 by referring to a counter value of the drum counter 904 after that.

On the other hand, at ST1009, in the case where the detection sensor 703 detected lights, it can be judged that, prior to the driving of the main motor 601 or even after the driving thereof, the movement 205 is in the interior of the second replacement unit 108. It can be judged that this state is one that, once the main motor 601 is driven, the movement 205 moves from the interior of the second replacement unit 108 to the exterior thereof, and with such the structure, the second replacement unit 108 is not mounted. Thus, the CPU 901 judges that the second replacement unit 108 is not mounted (ST1011). The CPU 901 displays this effect on the control panel 901.

As described above, in the case where the detection results of the sensor 703 indicate that, prior to the driving of the main motor 601 and after the driving thereof, the movement 205 moved from the interior of the second replacement unit 108 to the exterior thereof, it can be judged that the second replacement unit 108 is a new one. Furthermore, thereby, even in the case of dividing into the first replacement unit 107 and second replacement unit 108, a count start time of the drum counter 904 is accurately set in relation to lives of respective elements, and the lives can precisely be grasped, and also the new one detection and presence or absence of the second replacement unit 108 can be judged by using the same detecting means for both the functions, and the increasing number of detecting means can be decreased.

Furthermore, in the case where the detection results of the sensor 703 indicate that, both prior to the driving of the main motor 601 and after the driving thereof, the movement 205 is in the exterior of the second replacement unit 108, it can be judged that the mounted second replacement unit 108 is not a new one. Furthermore, thereby, even in the case of dividing into the first replacement unit 107 and second replacement unit 108, it can be judged that the second replacement unit 108 is not a new one, and in this case, the drum counter 904 for counting lives of the photosensitive roller 112 is not reset and continues to count as it is, thereby accurately grasping the lives.

Furthermore, In the case where the detection results of the sensor 703 indicate that, both prior to the driving of the main motor 601 and after the driving thereof, the movement 205 is at a first position, it can be judged that the second replacement unit 108 is non-mounted. Furthermore, as it is possible to detect that the second replacement unit 108 is non-mounted by the same sensor 703 as the sensor 703 for detecting the new one of the second replacement unit 108, the increasing number of sensors can be reduced. Furthermore, thereby, even in the case of dividing into the first replacement unit 107 and second replacement unit 108, it can be judged that the second replacement unit 108 is non-mounted. As the results, a high-pressure power source is not applied in a state that the second replacement unit 108 is not mounted, and it is possible to prevent a high-pressure power source from being unnecessarily applied and to enhance reliability in the apparatus.

Figures 11, 12:
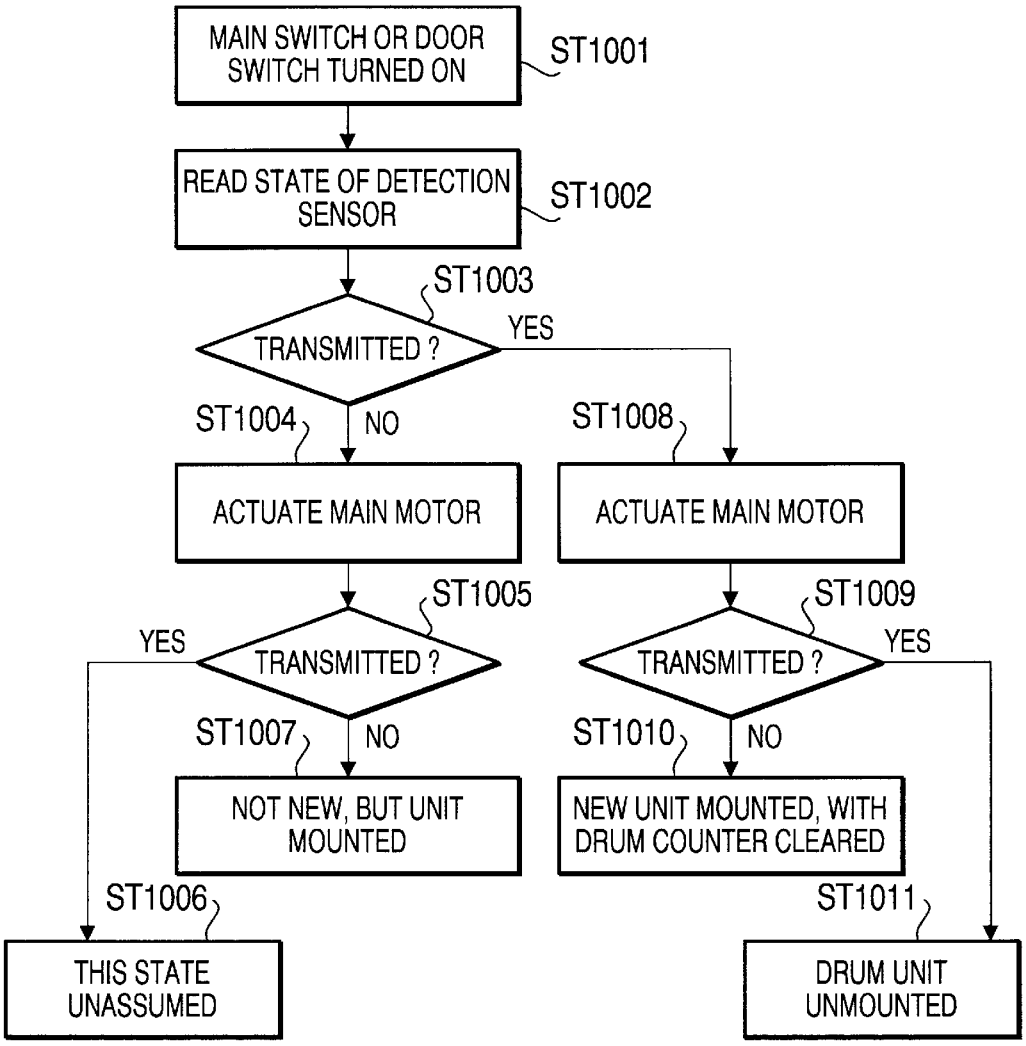
FIG. 11 is an operation flowchart of processing for judging whether the second replacement unit according to the embodiment is a new one or not and whether it has been mounted or not.
FIG. 12 is a table showing a judgment method effected by a CPU according to the embodiment.

Furthermore, a table shown in FIG. 12 is one that a sorting in the case where the CPU 901 judges is collected.

As described above, according to the embodiment, the movement 205 does not move from the interior of the second replacement unit 108 to the exterior of the second replacement unit 108 before the main motor 601 is driven, and this driving force is transmitted to the movement 205 via the discharge toner gear 507, discharge toner conveyance screw 124, discharge toner gear 203, and projection part 701. Once the movement has moved to the exterior, it does not move to the interior. Thereby, the positions of this movement prior to the driving of the main motor 601 and after the driving thereof are detected by the sensor 703, whereby it can certainly be judged whether or not the second replacement unit 108 is a new one. In the case where the second replacement unit 108 is a new one, the drum counter 904 which contrives to prolong the live of the photosensitive roller 112 is reset, and it is possible to start counting the number of record sheets recorded by the second replacement unit 108, and to precisely grasp the lives of the photosensitive roller 112.

Furthermore, according to the embodiment, it is possible to render both the new one detection of the second replacement unit 108 and mounting detection of the second replacement unit 108 by means of the detection sensor 703 and movement 205. In other words, it is possible to use the detection sensor 703 as serving both functions of the new one detection and mounting detection of the second replacement unit 108. Thus, there may be provided neither new one detecting means of the second replacement unit 108 nor mounting detecting means of the second replacement unit 108. Thus, it is possible to restrict an increase in the number of elements of the image forming apparatus 100 at a minimum.

Furthermore, according to the embodiment, the discharge toner gear 203 for moving the movement 205 can move by receiving a transmission of a rotation from the photoreceptor gear 506*a* for driving the photosensitive roller 112 included in the second replacement unit 108. Thus, if the photosensitive roller 112 which is an object of which lives are detected is not driven, the discharge toner gear 203 is not driven, so that the movement 205 does not move. Thereby, it can accurately be judged whether or not the photosensitive roller 112 is a new one by moving of the movement 205. As a result, it is possible to appropriately reset the drum counter 904 as a live counter of the photosensitive roller 112, and to accurately grasp the lives of the photosensitive roller 112.

Furthermore, according to the embodiment, the discharge toner gear 203 and projection part 701 as the moving means for moving the movement 205 are integrally formed with the discharge toner conveyance screw 124. Furthermore, the discharge toner gear 203 serves as a gear for transmitting a drive to the discharge toner collection box 206, too. Thus, it is contrived to miniaturize the second replacement unit 108. Furthermore, there are no problems in operations even if vibrations to a certain degree are applied on the discharge toner conveyance screw 124. Thereby, when the movement 205 is moved, even if vibrations are applied on the discharge toner conveyance screw 124 via the discharge toner gear 203, the discharge toner conveyance screw 124 operates without any problems.

In this connection, the embodiment was explained in the aspect that the movement 205 moves from the interior of the second replacement unit 108 to the exterior thereof, but may be adapted to such an aspect that the movement 205 moves from the exterior of the second replacement unit 108 to the interior thereof. In this case, it is necessary to make such a structure that, if the movement 205 enters the interior of the second replacement unit 108, it does not go to the exterior thereof. Furthermore, in this case, the detection results of the detection sensor 703 are ones reverse to the embodiment.

Furthermore, in the embodiment, the sensor 703 of a lights detecting system was used, but e.g. the sensor of a contact detecting system other than the above may be used.

In this connection, the embodiment was explained by use of the replacement unit separated into two sections, but the present invention may be applied to the replacement unit separated into two or more sections. Furthermore, the present invention may be applied to the unseparated replacement unit.

The present invention is not limited to the above described embodiments, and various variations and modifications may be possible without departing from the scope and spirit of the present invention.

This application is based on Japanese Patent Application No. 2000-031351 filed on Feb. 9, 2000, entire content of which is expressly incorporated by reference herein.

What is claimed is:

1. An image forming apparatus comprising:

a replacement unit having a projection which moves from a first position to a second position, and once moved to said second position being prohibited from returning to said first position, a moving member which moves said projection from said first position to said second position, a drive mechanism which moves said moving member to move said projection in conjunction with a driving of elements used in association with image formation, and a first replacement unit including a development roller and a second replacement unit including a photoreceptor, said first replacement unit and said second replacement unit being separable, said photoreceptor comprising said elements used in association with image formation;

a sensor which detects a position of said projection; and a controller which judges whether or not said replacement unit is a new replacement unit based upon respective positions of said projection detected by said sensor before and after said drive mechanism is driven.

2. The apparatus according to claim 1, wherein said drive mechanism includes gears which drive said elements for use in image formation, said moving member which moves said projection in response to a transmission of rotation from said gears.

3. The apparatus according to claim 1, wherein said first replacement unit includes a toner accommodation part which accommodates toner therein.

4. An image forming apparatus comprising:

a replacement unit having a projection which moves from a first position to a second position, and once moved to said second position being prohibited from returning to said first position, a moving member which moves said projection from said first position to said second position, and a drive mechanism which moves said moving member to move said projection in conjunction with a driving of elements used in association with image formation;

a sensor which detects a position of said projection; and a controller which judges whether said replacement unit is a new replacement unit based upon respective positions of said projection detected by said sensor before and after said drive mechanism is driven, wherein, when the respective positions of said projection detected by said sensor before and after said drive mechanism is driven indicate that said projection has moved from said first position to said second position, said controller judges that said replacement unit is a new replacement unit.

5. An image forming apparatus comprising:

a replacement unit having a projection which moves from a first position to a second position, and once moved to said second position being prohibited from returning to said first position, a moving member which moves said projection from said first position to said second position, and a drive mechanism which moves said moving member to move said projection in conjunction with a driving of elements used in association with image formation;

a sensor which detects a position of said projection; and a controller which judges whether said replacement unit is a new replacement unit based upon respective positions of said projection detected by said sensor before and after said drive mechanism is driven, wherein when the respective positions of said projection detected by said sensor before and after said drive mechanism is driven indicate that said projection is at said second position, said controller judges that said replacement unit is not a new replacement unit.

6. An image forming apparatus comprising:

a replacement unit having a projection which moves from a first position to a second position, and once moved to said second position being prohibited from returning to said first position, a moving member which moves said projection from said first position to said second position, and a drive mechanism which moves said moving member to move said projection in conjunction with a driving of elements used in association with image formation;

a sensor which detects a position of said projection; and a controller which judges whether said replacement unit is a new replacement unit based upon respective positions of said projection detected by said sensor before and after said drive mechanism is driven, wherein said moving member is a gear fitted to an end opposite to a drive-side end of a transporter which transports a remaining toner which is in a cleaning mechanism which removes the toner rremaining on a photoreceptor.

7. An image forming apparatus comprising:

a replacement unit having a projection which moves from a first position to a second position, and once moved to said second position being prohibited from returning to said first position, a moving member which moves said projection from said first position to said second position, and a drive mechanism which moves said moving member to move said projection in conjunction with a driving of elements used in association with image formation;

a sensor which detects a position of said projection; and a controller which judges whether said replacement unit is a new replacement unit based upon respective positions of said projection detected by said sensor before and after said drive mechanism is driven, where in said projection has a resilient protrusion that protrudes in a direction intersecting a direction of movement of said projection, said replacement unit has a stepped portion adapted to abut against said protrusion to push said protrusion from an original state toward a body of said projection while said projection moves from said first position to said second position, and said stepped portion retains said protrusion, which has been restored to the original state by a resiliency of said protrusion to restrain said projection from returning to said first position by its own weight, when said projection arrives at said second position.

8. An image forming apparatus comprising:

a replacement unit having a projection which moves from a first position to a second position, and once moved to said second position being prohibited from returning to said first position, a moving member which moves said projection from said first position to said second position, a drive mechanism which moves said moving member to move said projection in conjunction with a driving of elements used in association with image formation, and a first replacement unit including a development roller and a second replacement unit including a photoreceptor, said first replacement unit and said second replacement unit being separable, said photoreceptor comprising said elements used in association with image formation;

a sensor which detects a position of said projection; and a controller which judges whether or not said replacement unit is a new replacement unit and whether or not said replacement unit is mounted on said image forming apparatus, based upon respective positions of said projection detected by said sensor before and after said drive mechanism is driven.

9. The apparatus according to claim 8, wherein when the respective positions of said projection detected by said sensor before and after said drive mechanism is driven indicate that said projection has moved from said first position to said second position, said controller judges that said replacement unit is not a new replacement unit and that said second replacement unit is mounted thereon.

10. The apparatus according to claim 8, wherein, when the respective positions of said projection detected by said sensor before and after said drive mechanism is driven indicate that said projection is at said second position, said controller judges that said replacement unit is not a new replacement unit and that said second replacement unit is mounted thereon.

11. The apparatus according to claim 8, wherein said drive mechanism includes gears which drive said elements for use in image formation, said moving member which moves said projection in response to a transmission of rotation from said gears.

12. The apparatus according to claim 8, wherein said first replacement unit includes a toner accommodation part which accommodates toner therein.

13. An image forming apparatus comprising:

a replacement unit having a projection which moves from a first position to a second position, and once moved to said second position being prohibited from returning to said first position, a moving member which moves said projection from said first position to said second position, and a drive mechanism which moves said moving member to move said projection in conjunction with a driving of elements used in association with image formation;

a sensor which detects a position of said projection; and a controller which judges whether or not said replacement unit is a new replacement unit and whether or not said replacement unit is mounted on said image forming apparatus, based upon respective positions of projection detected by said sensor before and after said drive mechanism is driven, wherein when the respective positions of said projection detected by said sensor before and after said drive mechanism is driven indicate that said projection is at said first position, then said controller judges that said replacement unit is not mounted thereon.

14. An image forming apparatus comprising:

a replacement unit having a projection which moves from a first position to a second position, and once moved to said second position being prohibited from returning to said first position, a moving member which moves said projection from said first position to said second position, and a drive mechanism which moves said moving member to move said projection in conjunction with a driving of elements used in association with image formation;

a sensor which detects a position of said projection; and a controller which judges whether or not said replacement unit is a new replacement unit and whether or not said replacement unit is mounted on said image forming apparatus, based upon respective positions of projection detected by said sensor before and after said drive mechanism is driven, wherein said moving member is a gear fitted to an end opposite to a drive-side end of a transporter which transports a remaining toner which is in a cleaning mechanism which removes that toner remaining on a photoreceptor.

15. An image forming apparatus comprising:

a replacement unit having a projection which moves from a first position to a second position, and once moved to said second position being prohibited from returning to said first position, a moving member which moves said projection from said first position to said second position, and a drive mechanism which moves said moving member to move said projection in conjunction with a driving of elements used in association with image formation;

a sensor which detects a position of said projection; and a controller which judges whether or not said replacement unit is a new replacement unit and whether or not said replacement unit is mounted on said image forming apparatus, based upon respective positions of projection detected by said sensor before and after said drive mechanism is driven, wherein said projection has a resilient protrusion that protrudes in a direction intersecting a direction of movement of said projection, said replacement unit has a stepped portion adapted to abut against said protrusion to push said protrusion from an original state toward a body of said projection while said projection moves from said first position to said second position, and said stepped portion retains said protrusion, which has been restored to the original state by a resiliency of said protrusion to restrain said projection from returning to said first position by its own weight, when said projection arrives at said second position.

* * * * *

UNITED STATES PATENT AND TRADEMARK OFFICE

CERTIFICATE OF CORRECTION

PATENT NO. : 6,298,202 B1
DATED : October 2, 2001
INVENTOR(S) : N. Fushiya et al.

It is certified that error appears in the above-identified patent and that said Letters Patent is hereby corrected as shown below:

Title page,
Item [73], Assignee, the following Assignee was omitted and should be included:
-- Matsushita Graphic Communication Systems, Inc., Tokyo, Japan --.

Signed and Sealed this

Twentieth Day of August, 2002

*Attest:*

*Attesting Officer*

JAMES E. ROGAN
*Director of the United States Patent and Trademark Office*